United States Patent [19]

Winstone

[11] Patent Number: 4,856,856

[45] Date of Patent: Aug. 15, 1989

[54] PORTABLE ARTIST'S SUPPLY BOX AND EASEL

[75] Inventor: Violet M. Winstone, Laverne, Calif.

[73] Assignee: Rebecca Drusilla Winston, Laverne, Calif.

[21] Appl. No.: 221,870

[22] Filed: Jul. 20, 1988

[51] Int. Cl.[4] ..... H02K 13/00

[52] U.S. Cl. ..... 312/231; 206/44 R; 312/244

[58] Field of Search ..... 206/44 R; 108/33, 50; 312/231, 232, 196, 244, 323

[56] References Cited

U.S. PATENT DOCUMENTS

| | | | |
|---|---|---|---|
| 2,638,397 | 5/1953 | Wykoff | 312/231 |
| 3,168,363 | 2/1965 | Monsour | 312/231 |
| 3,202,471 | 8/1965 | Wilson | 312/231 |
| 3,414,343 | 12/1968 | Thomas | 312/231 |
| 3,476,456 | 11/1969 | Canavan | 312/244 X |
| 3,540,787 | 11/1970 | Ford | 312/231 |
| 4,093,326 | 6/1978 | Ford | 312/231 |
| 4,123,127 | 10/1978 | Ford | 312/230 |
| 4,294,497 | 10/1981 | Daniel | 312/231 |
| 4,327,630 | 2/1983 | Fuhri | 312/231 |

*Primary Examiner*—Joseph Falk
*Attorney, Agent, or Firm*—Milton S. Gerstein

[57] ABSTRACT

A combined and portable artist's supply box and easel, which includes a permanent easel also serving as a handle by which the device is carried and transported. A second foldable and removable easel is also provided for providing a greater supporting easel surface. The second, removable easel is stored when not used in a special compartment of the device. The device includes other compartments and drawers for the storage of supplies, material, and tools. In a second embodiment, the device is designed for support on a bed for use by bed-ridden and infirm persons in hospitals or homes, or for children.

20 Claims, 7 Drawing Sheets

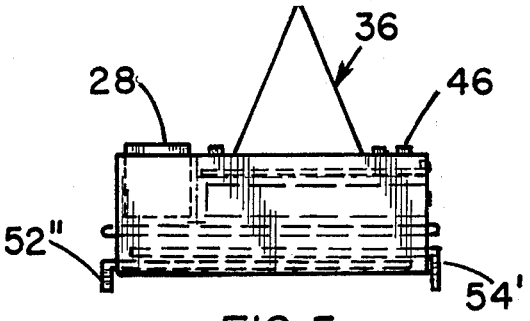
FIG. 5
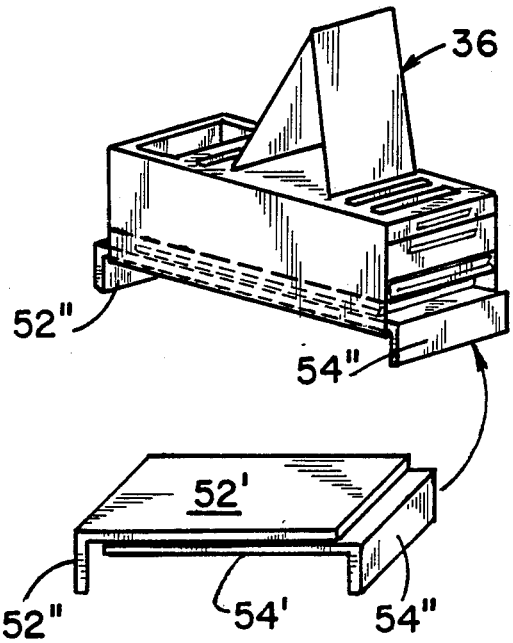
FIG. 6
FIG. 7
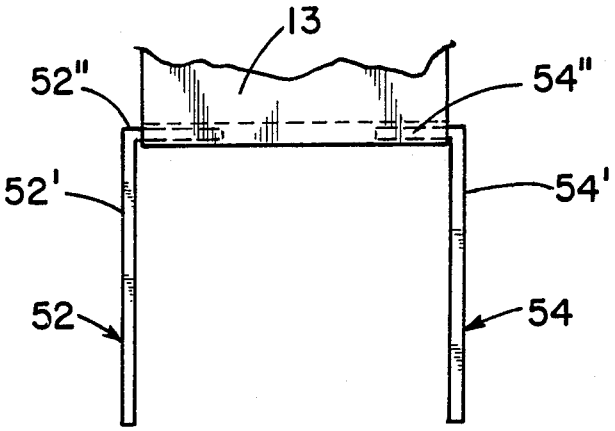
FIG. 8

PORTABLE ARTIST'S SUPPLY BOX AND EASEL

BACKGROUND OF THE INVENTION

The present invention is directed to a portable combined artist's supply box and easel for professional and amateur artists, as well as for art students, novices, and the like. It is intented to allow for one's artist's supplies and necessities to be easily transported from one location to another, so that one may draw where he wishes. There exist prior-art portable easels, as well as boxes for storing and transporting artist's supplies. However, such prior art devices are relatively difficult and time-comsuming to set up, and bulky and difficult to transport.

SUMMARY OF THE INVENTION

It is the primary objective of the present invention to provide a portable combined artist's supply box and easel that is easily transportable, and facilely set up at the site where it is to be used, such portable easel being a self-contained, combined artist's supply cabinet and easel, obviating the need for return trips to an automobile, house, apartment, etc., for additional supplies, materials and tools.

It is another objective of the present invention to provide such a portable combined artist's supply box and easel that is a self-contained unit having drawers and compartments for storing necessary supplies and materials, and which also has an integrally formed permanent easel which also serves as a carrying handle for carrying and transporting the device.

It is yet another objective of the present invention to provide such a portable combined artist's supply box and easel that also has a foldable portable easel that is easily stored in a special compartment therefor, and which may be used against the permanent easel in order to form a larger easel surface area than that provided by the permanent easel.

In a modification, the portable combined supply box and easel is provided with a pair of supporting legs, which, in their non-use state, are stored in a special compartment of the supply box of the invention, and pulled outwardly therefrom and then inverted when it is desired to support the device for use.

In a second embodiment of the invention, the combined artist's supply box and easel is designed for use by bed-ridden or infirm persons in a hospital or at home, which embodiment is provided with self-standing legs for straddling the person so that it is positioned above the person and supported on the bed proper.

In a modification of the second embodiment, the device is designed for use by children, such that the permanent easel thereof is formed on one exterior surface into a peg board.

BRIEF DESCRIPTION OF THE DRAWING

The invention will be more readily understood with reference to the accompanying drawings, wherein:

FIG. 5 is a side elevation view of the modification of FIG. 4 showing the pair of legs in their nonuse, stored condition;

FIG. 6 is an isometric view of the modification of FIG. 4 showing the pair of support legs in their nonuse, stored condition;

FIG. 7 is an isometric view of only the two stored supporting legs to show the manner by which they are stored in a special compartment of the device of the invention;

FIG. 8 is a side elevation view showing the modification of FIG. 4 in the state thereof where the pair of supporting legs are in their extended, operative condition.

DETAILED DESCRIPTION OF THE INVENTION

Figure 1:
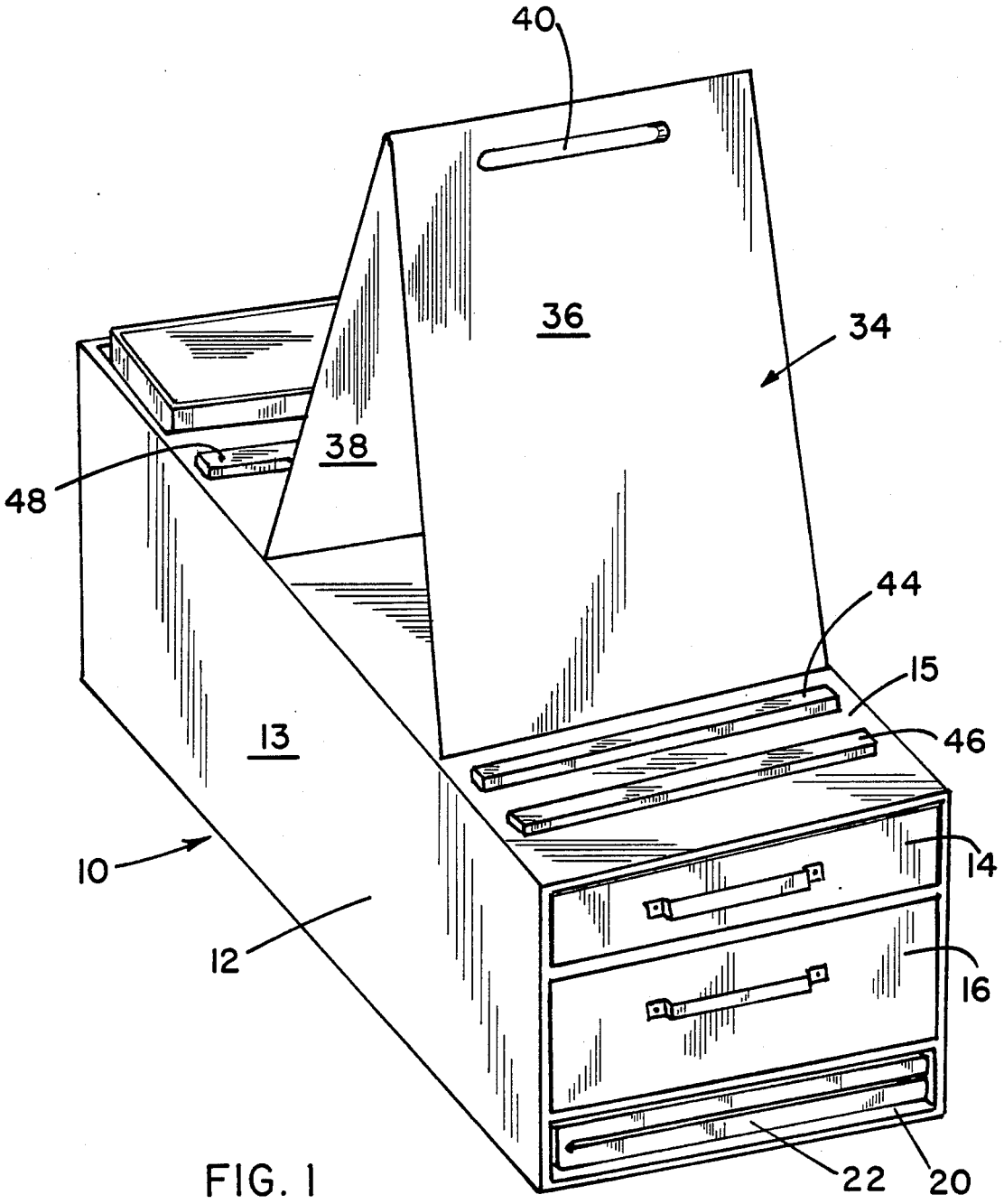
FIG. 1 is an isometric view of the preferred form of the portable combined artist's supply box and easel of the invention.
Figure 2:
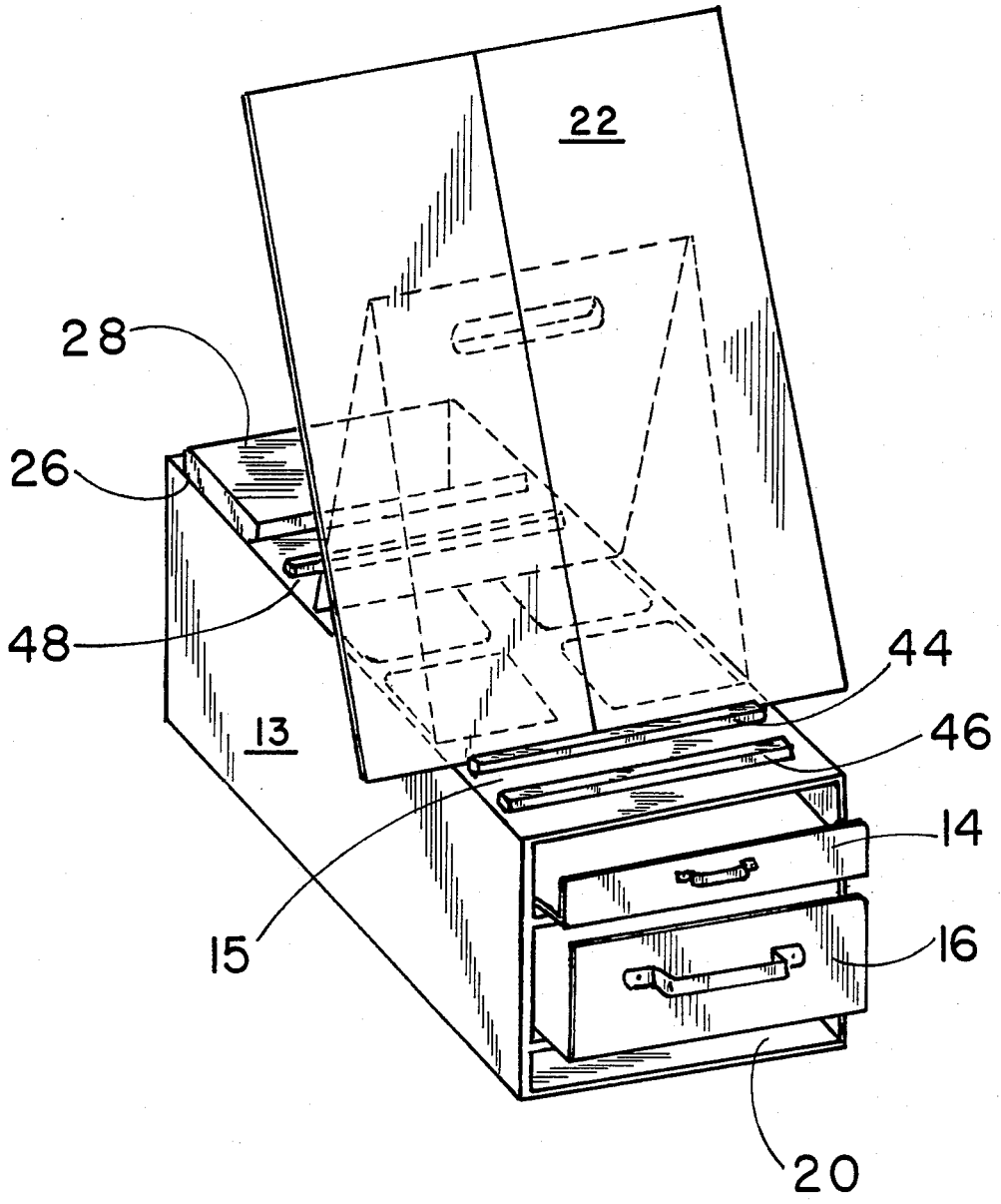
FIG. 2 is an isometric view similar to FIG. 1 but showing the portable, foldable easel erected for use against the permanent easel of the invention.
Figure 3:
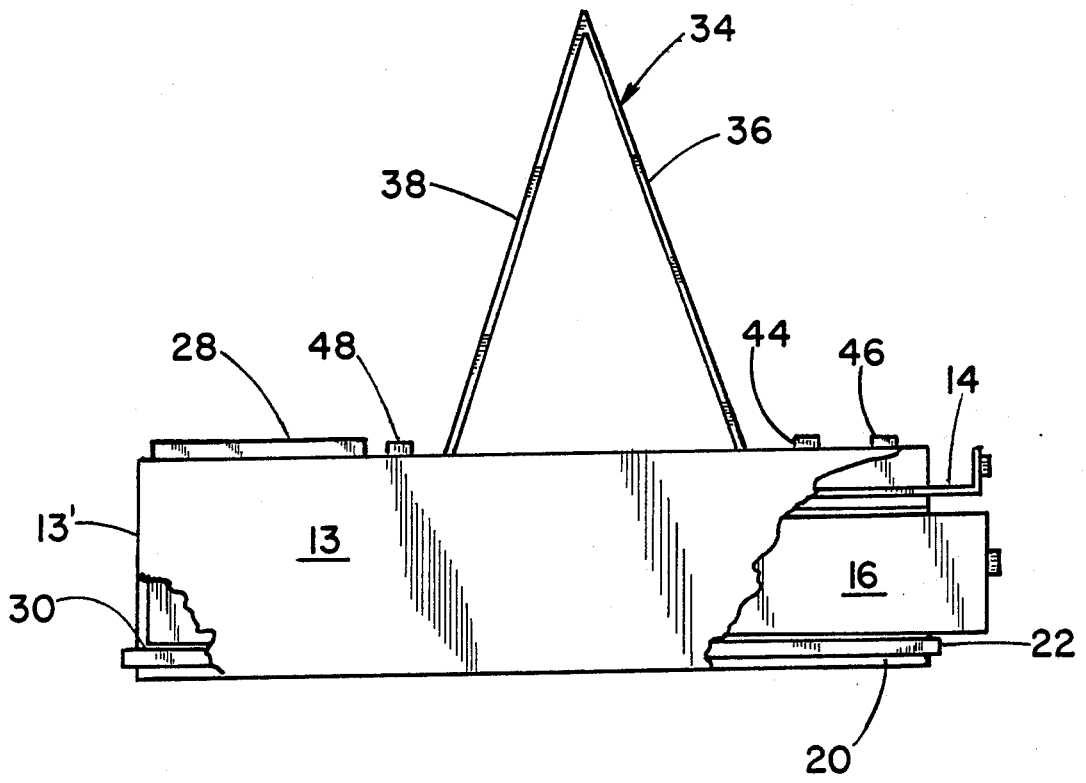
FIG. 3 is a side elevation view of the device of FIG. 1, with parts broken away to show the arrangement of the storage compartments and drawers.
Figure 4:
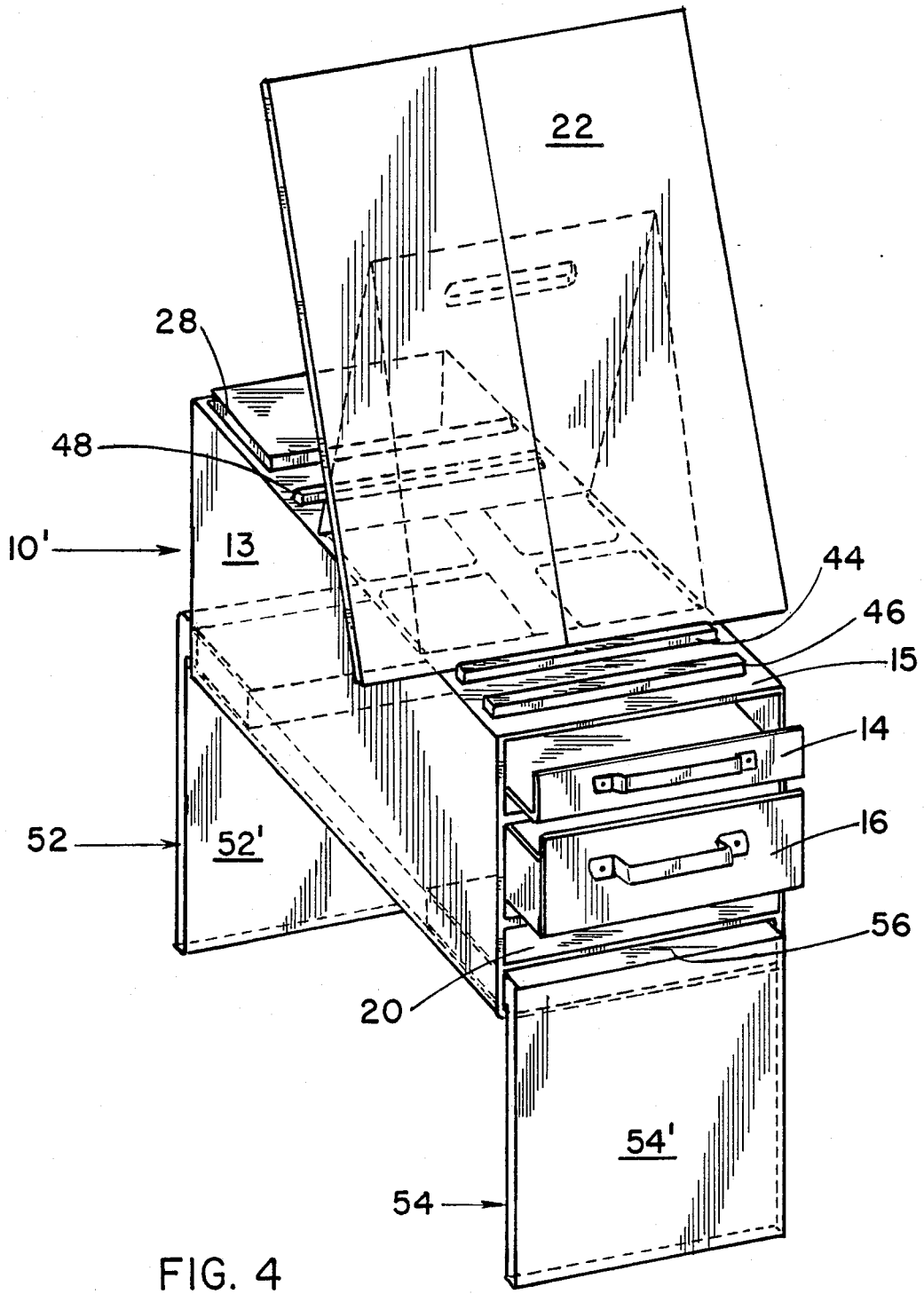
FIG. 4 is an isometric view of a modification of the device of FIG. 1 in which there are provided a pair of supporting legs for supporting the device when being used.

Referring now to the drawings in greater detail, the preferred embodiment of the invention is shown in FIGS. 1–3, and is indicated generally by reference numeral 10. The portable combiend artist's supply box and easel 10 may be made of wood, plastic, or cardboard, such that it is light and durable enough to permit of storage and transport. The box 10 includes a main frame or housing 12 defining a hollow interior, the housing 12 defining a pair of side walls 13, a rear wall 13', a top wall 15, and a bottom support wall. In the forward-facing portion of the housing 12, there are provided are pair of pull-out drawers, 14, 16, the lower drawer 16 being used for storing artist's supplies, material, tools and the like. The upper drawer 14 is relatively shorter in height for specifically storing a palette. The interior side walls of the housing 12 are provided with runners for allowing for the sliding opening and closing of the drawers in a conventional manner. The drawers 14, 16 preferably extend approximately $\frac{3}{4}$ of the length of the housing. Below the lower drawer 16, there is provided a relatively short or narrow passageway or compartment 20 extending the entire length of the housing 12, as seen in FIG. 3. This compartment 20 is used for storing a foldable, portable easel 22. The portable easel 22, when folded and stored in the compartment 20, projects outwardly from the rear and front of the housing 12, as shown in FIG. 3. The portable easel 22 folds about a longitudinal, center fold-line extending parallel to the length of the housing 12, when the portable easel 22 is stored in compartment 20. The forward and rearward projection of the portable easel allows for a more easy removal thereof from the compartment 22, by providing a portion that may be easily gripped by a hand. The rear portion of the housing 12 is also provided with a relatively deep well region 26 for removably storing a supply bin 28, for storing other supplies and material, or the like, therein. The well region 26 extends downwardly most of the depth of the hollow interior of the housing 12, with the storage bin 28 resting upon a floorpartition portion 30 located directly above the hollow interior defined by the compartment 20. It is within the scope of the invention to allow for the bin 28 to rest directly upon the portable easel 22 when the easel is stored, and for the bin 28 to rest directly when the easel 22 is removed.

The upper or top surface 15 of the housing 12 is provided with a fixed easel 34 defining a triangular shape having a pair of intersecting, sloping surfaces 36, 38. Each of the sloping surfaces defines a lower edge which is fixedly secured to the upper surface 15. When the box 10 is made of cardboard, such fixed securement may be achieved by the provision of a lower flap for each lower edge, which flap may be adhesively secured to the interior surface of the upper surface 15 after passing through a respective slot formed in the upper surface 15. When the box 10 is made of wood or plastic, the permanent easel may be formed integrally with the housing. Each sloping surface 36, 38 has an elongated cutout 40 by which the entire box may be grasped by a hand and transported, the permanent easel thus also serving as a carrying handle. Positioned forwardly of the front sloping surface 36 of the permanent easel are a pair of elongated canvas stops 44, 46, each substantially extending the width of the top surface 15. These canvas stops serve in conjunction with the portable, foldable easel 22, in the manner shown in FIG. 2. When the portable easel 22 is removed and unfolded for use, it is laid against one of the sloping surfaces 36, 38, such as the sloping surface 38 shown in FIG. 2. One of the pair of canvas stops 44, 46 is used as a support for the lower edge of the portable easel, in order to stabilize it for use. Depending upon the desired angle of use of the portable easel, one or the other of the canvas stops may be used. The portable easel is considerably greater in size than the permanent easel, providing a choice to the artist as to the size of easel used. The rear portion of the top surface 15 is also provided with a canvas stop 48 if it is desired to erect the portable easel against the rear sloping surface 38. The removable tray or bin 28 serves as the second canvas stop for the rear of the top surface by virtue of the fact that the top rim of the bin protrudes upwardly beyond the planar top surface 15. The portable easel, in the preferred embodiment, measures 24" by 36", while the permanent easel measurs 14" by 12.5". This height of the permanent easel also serves to define another storage area within the interior of the sloping surfaces 36, 38, in which may be stored books, canvases, and the like, supported on the top wall surface 15. The housing proper measures 22" in length, 14" in width, and 7.25" in height. The drawer 14 has dimensions sufficient enough to store a palette 12" by 16".

FIGS. 4–8 show a modification of the device, and is indicated by reference numeral 10', where like parts are indicated by like reference numerals. The device 10' differs from that of FIG. 1 by the provision of a pair of portable legs 52, 54, and additional lower compartment 56 for storing the legs when not in use and for holding the legs erect when in use. The legs elevate the box proper above the ground or floor. This compartment 56 is situated directly below the portable-easel storage compartment 20, and is approximately the same size thereof. Each leg 52, 54 is a substantially L-shaped member, defining a long supporting leg portion 52', 54', respectively, and a shorter supporting leg portion 52", 54". When the legs 52, 54 are not in use for supporting the box 10', elevated above the ground or floor, they are stored in the compartment 56 in the manner shown in FIG. 5–7, where the sections 52', 54' are stacked one above the other, with the sections 52", 54" projecting downwardly from the ends of the compartment, in the manner clearly shown in FIG. 7. When in use, the legs are removed, and the shorter sections 52", 54" are inserted into the respective open ends of the compartment 56, so that the longer sections 52', 54' now extend perpendicularly downwardly, in the manner shown in FIG. 8, where the shorter sections 54", 56" now couple the longer sections to the box proper, to allow for such free standing. When the legs are again stored, the shorter sections 52", 54" are slid out of of the respective ends of the compartment 56, and the legs stored in the manner described above. In the case of a wooden or plastic device, the legs may be provided with living hinges between, the two sections of each leg, whereby during storage, the leg sections are collapsed onto to each other and stored entirely in the compartment 56.

Figure 9:
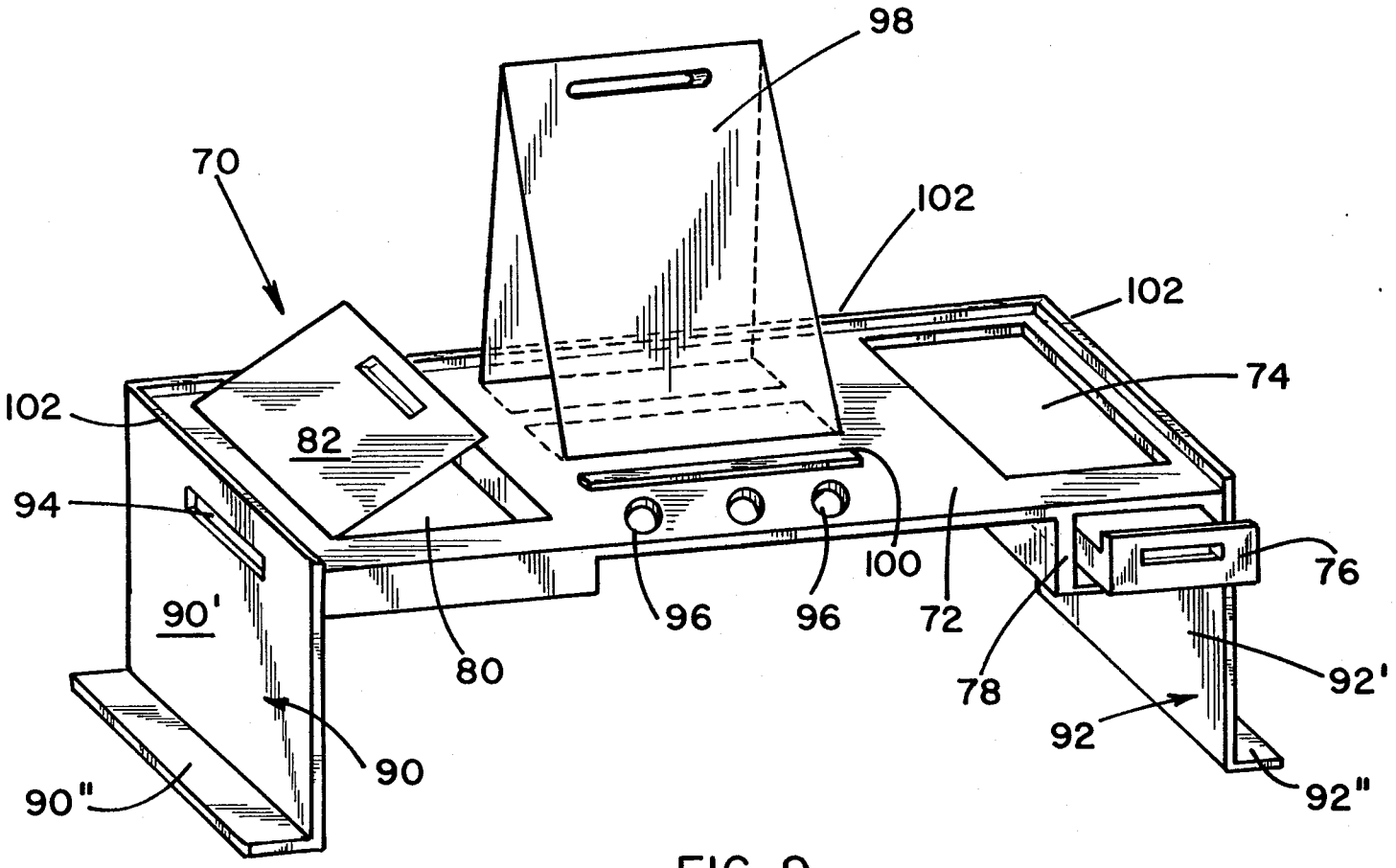
FIG. 9 is an isometric view of a second embodiment of the invention designed for use on a bed for bed-ridden and infirm persons.

A second embodiment of the invention is shown in FIG. 9. This version is for use in hospitals or the home for bed-ridden and infirm persons. The device 70 of FIG. 9 is specially adapted for use in a bed, and is designed in a tray-like format. The device 70, instead of having a hollow housing of the first embodiment, has a first upper desk-like, flat surface 72 in which which is formed a storage bin 74 of relatively narrow depth, for storing a palette and art supplies, below which is provided a pull-out drawer 76 slidingly running in a compartment 78 depending from the undersurface of the flat surface 72. On the opposite end of the flat surface 72, there is provided another storage area 80 which is closable by a pivotal lid 82. A pair of downwardly extending leg supports 90, 92 are provided extending perpendicularly from the end edge surfaces of the first flat surface 72. Each leg support has a longer vertical section 90', 92', respectively, and a shorter, right-angle section 90", 92", respectively, for providing firm support. Each section 90', 92' is formed with an elongated, hand-gripping slot 94 by which the artist's tray 70 may be carried. A plurality of wells 96 are also provided for storing containers, turpentine, water, oil, and the like. As in the first embodiment, a fixed easel 98 is affixed to the top surface of the flat desk-type surface 72, which fixed or permanent easel has a pair of sloping surfaces, as in the first embodiment, which sloping surfaces also include elongated slots for the insertion of a hand, to allow for the artist's tray 98 to be transported by one hand. One canvas stop 100 is provided forwardly of the forward sloping surface of the permanent easel against which the lower edge of a portable easel (not shown) may rest, as in the first embodiment. The desk-type flat surface 72 is surrounded along the rear and side circumferential edges by a beaded rim or lip 102, the rear portion of which directly behind the rear sloping surface of the permanent easel also serves as a canvas stop for the portable easel. In the preferred form, the artist's tray 70 is 32" in length, as taken from one leg to the other leg, and has a width of 15", with a height of 12". The hollow spaced defined between the interior surfaces of the sections 90', 92', and the lower surface of the desk-type flat surface 72 provides the space for accommodating the upper trunk portion of a person lying in bed, in the style of a bed food-tray.

Figure 10:
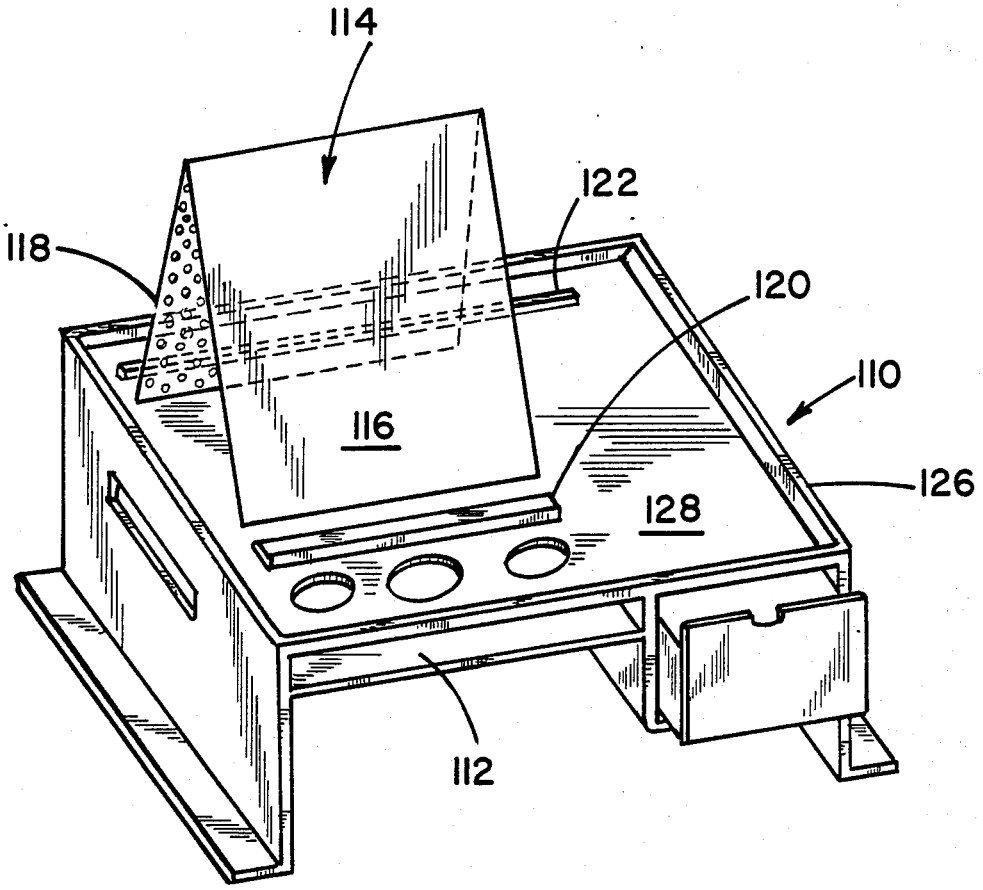
FIG. 10 is an isometric view of a modification of FIG. 9 designed for use on bed of children.

FIG. 10 is a modification of the artist's tray of FIG. 9 which is designed for children's beds, so that a child may draw, paint, and the like to bed. The artist's tray 110 of FIG. 10 is designed like a food tray, as in the tray 70, and is basically the same as the tray 70 except for smaller size, the addition of the lower storage area 112 meant to simulate a child's schoolroom desk instead of the storage bin 80, and for the design of the permanent easel 114. The permanent easel 114 is provided with a forwardly sloping surface 116, and a rearwardly sloping surface 118. However, the rearwardly sloping surface 118 is formed into a pegboard-type surface by which the child may hang for exhibition his or her drawings. A pair of canvas stops 120, 122 are also provided, as before. An upper circumferential lip 126 surrounds the upper flat surface 128 of the tray. The artist's tray for youth 110, in the preferred embodiment, has a length of 24", as taken in the direction between the supporting legs thereof, a height of 12", and a width of depth of 15".

While a specific embodiment of the invention has been shown and described, it is to be understood that numerous changes and modifications may be made therein without departing from the scope, spirit and intent of the invention as set forth in the appended claims.

What I claim is:

1. A portable combined artist's supply box and easel, comprising:

a frame defining a top working surface;

a permanent easel affixed to said top working surface, said permanent easel comprising at least one section having at least a first sloping surface;

a portable easel of greater size than said permanent easel, said portable easel comprising at least one fold line about which it is foldable for storage, and a lower edge surface; said top working surface of said frame comprising at least one canvas stop against which said lower edge surface may abut, said portable easel being capable of support by said at least one first sloping surface of said permanent easel and said at least one canvas stop, whereby an artist has the option of choosing to use either easel.

2. The device according to claim 1, wherein said permanent easel comprises a pair of sections meeting at an uppr apex and extending divergingly downwardly to said top working surface, one said section comprising said first sloping surface, and the other said section comprising a second sloping surface, said pair of sections defining therebetween a hollow space between which items may be stored on said top working surface therebetween.

3. The device according to claim 2, wherein said frame comprises a plurality of canvas stops, each said canvas stop being a substantially elongated member projecting upwardly from the flat planar surface of said top workng surface, at least one said canvas stop being operatively associated and in close proximity to said first surface of said permanent easel, and at least one said canvas stop being operatively associated and in close proximity to said second surface of said permanent easel, whereby either sloping surface may be used to support said portable easel.

4. The device according to claim 2, wherein said frame comprises a housing defining a substantially hollow interior, said housing comprising means for storing supplies.

5. The device according to claim 4, wherein said housing comprises a pair of said wall surfaces, a rear wall surface, and a bottom wall surface; said housing further comprising a compartment for storing said portable easel in the folded state thereof.

6. The device according to claim 5, wherein said compartment has an open front and rear end, said compartment having a length less than the length of said portable easel so that the ends of said portable easel protrude outwardly from said front and rear ends of said compartment when said portable easel is stored in said compartment in its folded state, whereby the protruding ends of said portable easel may be easily grasped by a hand for removing said portable easel from said compartment.

7. The device according to claim 4, wherein said means for storing supplies comprises a well-region formed in said housing, said top working surface having an opening formed therein constituting the opening of said well-region, and a removable storage bin insertable into said well-region for removable emplacement therein, said storage bin having a height greater than the depth of said well-region so that a circumferential upper portion of said storage bin projects upwardly beyond said top working surface, a section of said projecting upper portion of said storage bin facing one of said first and second surfaces of said permanent easel also serving as another canvas stop against which said lower edge surface of said portable easel may abut.

8. The device according to claim 7, wherein said at least one canvas stop is positioned on said top working surface between said section of said storage bin and said one of said first and second surfaces.

9. The device according to claim 8, wherein said means for storing comprises at least one slidable drawer storing a palette.

10. The device according to claim 4, further comprising a first separate leg support and a second separate leg support for elevating said housing above the ground; said housing comprising another compartment for storing said leg supports therein, said another compartment being located below said compartment for storing said portable easel; each of said first and second leg supports comprising a first longer section having a lower edge surface, and a second shorter section extending transversely to said first longer section from said lower edge surface of said first longer section; said another compartment being open therethrough and having a forward open entrance mouth and a rearward open entrance mouth; said first longer sections of said leg supports lying one above the other in said another compartment, and said second shorter sections protruding outwardly from a respective said forward and rearward open entrance mouth of said another compartment.

11. The device according to claim 2, wherein said frame comprises a food-tray like housing comprising said top working surface, said top working surface comprising a pair of end edge surfaces, a pair of downwardly extending supporting legs projecting transversely to and connected with said pair of end edge surfaces of said to working surface, said housing defining a space between said pair of supporting legs and below said top working surface for receiving therein a portion of a person's body lying in a bed, whereby an infirm and bed-ridden person may be provided with all of the artist's necessities for painting.

12. The device according to claim 11, wherein said housing further comprises an upwardly extending lip projecting from one side edge surface of said top working surface, said one side edge surface extending parallel to and in close proximity to the other of said first and second surfaces of said permanent easel, a section of said lip juxtaposition adjacent said other surface of said permanent easel serving as another canvas stop for said other surface; said another canvas stop and said at least one canvas stop being positioned on opposite sides of said permanent easel.

13. The device according to claim 12, wherein said top working surface comprises a plurality of wells for storing oil, water, and turpentine, said wells being located adjacent the other side edge surface of said top working surface adjacent said at least one canvas stop.

14. The device according to claim 11, wherein each of said supporting legs comprises an elongated cutout in an upper portion of the respective said supporting leg for serving as means by which the frame may be carried.

15. The device according to claim 14, wherein said frame is shaped like a child's schoolroom desk, and comprises a lower compartment, and at least side drawer.

16. The device according to claim 2, wherein one of said first and second surfaces of said permanent easel comprises peg holes for displaying drawings.

17. The device according to claim 1, wherein said frame comprises a food-tray like housing comprising said top working surface, said top working surface comprising a pair of end edge surfaces, a pair of downwardly extending supporting legs projecting transversely to and connected with said pair of end edge surfaces of said top working surface, said housing defining a space between said pair of supporting legs and below said top working surface for receiving therein a portion of a person's body lying in a bed, whereby an infirm and bed-ridden person may be provided with all of the artist's necessities for painting.

18. A portable combined artist's supply box and easel, comprising:

a frame defining a top working surface;

a permanent easel affixed to said top working surface, said permanent easel comprising a first section defining a first sloping surface and a second section defining a second sloping surface, said first and second sections meeting at an upper apex and extending divergingly downwardly to said top working surface, said first and second sloping surfaces also meeting at said upper apex and diverging downwardly therefrom; said first and second sections being fixedly joined to each other at said upper apex thereof for immovable attachment;

said first and second sections forming a triangular-shaped structure with the portion of said top working surface therebetween;

each of said first and second sections comprising a lower end portion fixedly connected to a respective part of said top working surface;

at least one of said first and second sections comprising handle-carrying means formed in a portion thereof by which the fingers of a hand may carry said frame; and said top working surface comprising at least one stop against which a canvas or the like may abut while resting against one of said sloping surfaces of said permanent easel, said at least one stop being spaced from the lower portion of one of said first and second sloping surfaces.

19. The device according to claim 18, further comprising a portable easel of greater size than said permanent easel, said portable easel comprising at least one fold line about which it is foldable for storage, and a lower edge surface for abutment against said least one stop.

20. The device according to claim 18, wherein said frame comprises a plurality of canvas stops, each said canvas stop being a substantially elongated member projecting upwardly from said top working surface, at least one said canvas stop being operatively associated and in close proximity to said first surface of said permanent easel, and at least one said canvas stop being operatively associated and in close proximity to said surface of said permanent easel.

* * * * *